US008348869B2

(12) United States Patent
Su et al.

(10) Patent No.: US 8,348,869 B2
(45) Date of Patent: Jan. 8, 2013

(54) UPPER LIMBS REHABILITATION DEVICE

(75) Inventors: Fong-Chin Su, Tainan (TW); Wei-Jr Lin, Tainan (TW); Chih-Han Chang, Tainan (TW); Li-Chieh Kuo, Tainan (TW); Cheng-Chun Chen, Fengshan (TW); Chung-Ying Tsai, Kaohsiung (TW)

(73) Assignee: SU, Fong-Chin, Tainan (TW)

( * ) Notice: Subject to any disclaimer, the term of this patent is extended or adjusted under 35 U.S.C. 154(b) by 289 days.

(21) Appl. No.: 12/850,212

(22) Filed: Aug. 4, 2010

(65) Prior Publication Data

US 2012/0035512 A1 Feb. 9, 2012

(51) Int. Cl.
*A61H 1/00* (2006.01)

(52) U.S. Cl. ..... 601/33; 601/23

(58) Field of Classification Search ..... 601/33, 601/23; 128/878–879; 482/8, 79, 80, 93, 482/98–102, 114, 127, 139
See application file for complete search history.

(56) References Cited

U.S. PATENT DOCUMENTS 3,290,985 A * 12/1966 Bains et al. ..... 359/896
4,772,015 A * 9/1988 Carlson et al. ..... 482/92
6,106,437 A * 8/2000 Brooks ..... 482/10
7,883,444 B1 * 2/2011 Wu ..... 482/4
8,066,621 B2 * 11/2011 Carlson ..... 482/8

* cited by examiner

*Primary Examiner* — Michael A. Brown
(74) *Attorney, Agent, or Firm* — Muncy, Geissler, Olds & Lowe, PLLC

(57) ABSTRACT

An upper limbs rehabilitation device includes a main body, a rail, a movable member and a grip, wherein the main body has a first link and a second link pivotably connected to the first link. The rail is connected to the second link. The user holds the grip that is pivotably connected to the movable member and swings the upper limb to move the movable member along the rail so as to exercise the upper limb in multiple degrees of freedom.

9 Claims, 3 Drawing Sheets

UPPER LIMBS REHABILITATION DEVICE

FIELD OF THE INVENTION

The present invention relates to an upper limbs rehabilitation device, and more particularly, to an upper limbs rehabilitation device having multiple degrees of freedom.

BACKGROUND OF THE INVENTION

Along with the aging society comes and many patients have nervous system diseases, more and more patients need rehabilitation. In order to accelerate the rehabilitation of the upper limbs, there are multiple rehabilitation devices are developed which are designed to assist the users to exercise the upper limbs correctly so that the upper limbs can operate normally as soon as possible. One of the known rehabilitation device is disclosed in U.S. Pat. No. 4,772,015 which discloses an arm and shoulder exercise machine, wherein the user holds the grip assembly and operates the exercise arm to swing the user's arm to rehabilitate the upper limb.

However, the steel tube of the arm and shoulder exercise machine that is connected to the electrically-operated brake cannot rotate, and the rehabilitation device that exercises the arms occupies a certain space. In order to meet different needs of the users, the arm and shoulder exercise machine has to be moved from one place to another. Although there are casters for convenience of movement, the machine cannot freely move in a narrow space.

Besides, the user having an arm that can use the exercise arm of the machine, the arm is inconvenient to apply force to the machine.

SUMMARY OF THE INVENTION

The present invention intends to provide an upper limbs rehabilitation device having multiple degrees of freedom.

The present invention relates to an upper limbs rehabilitation device which comprises a main body having a first link and a second link which is pivotably connected to the first link. A rail is connected to the second link. A movable member is connected to the rail and slidable along the rail. A grip is pivotably connected to the movable member.

The second link is rotatable relative to the first link so as to rotate to a desired orientation for convenience of holding to different users. The grip that is pivotably connected to the movable member can exercise the joint of the shoulder. The movable member is moved along the rail which provides a force to the movable member so as to assist the user to rehabilitate.

The rail is a curved rail and includes a toothed rack. The movable member includes a gear which is engaged with the toothed rack.

The gear is connected to a motor which provides power to move the movable member along the rail such that the users who cannot freely move their arms can operated the device.

The grip is connected with a resistance sensor which is electrically connected to the motor, the sensor detects the resistance that the user's arm applies to the grip and when the resistance reaches a critical value, the motor is stopped to avoid injury to the arm.

A resistance control unit is connected between the rail and the movable member. The resistance control unit comprises two rollers and two adjustment members. The two rollers are connected between the rail and the movable member. The two rollers are in contact with the rail and slidable along the rail. The two adjustment members each have a bolt and a spring.

The two bolts respectively extend through the two springs and the movable member and are threadedly connected to the two rollers. The two springs provide the resistance between the movable member and the rail. When the movable member moves along the rail, the user has to overcome the resistance to achieve the purpose of weight training.

The first link is connected with a cart so as to easily move to meet different users' needs.

The primary object of the present invention is that the rail is rotatable so that the users in different positions can use the device.

The grip is rotatable so as to exercise the joints of the upper limbs.

The movable rail assists the user to exercise and rehabilitate upper limbs.

During operation, the resistance or the adjustment of the upper limb can avoid the users from being injured.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
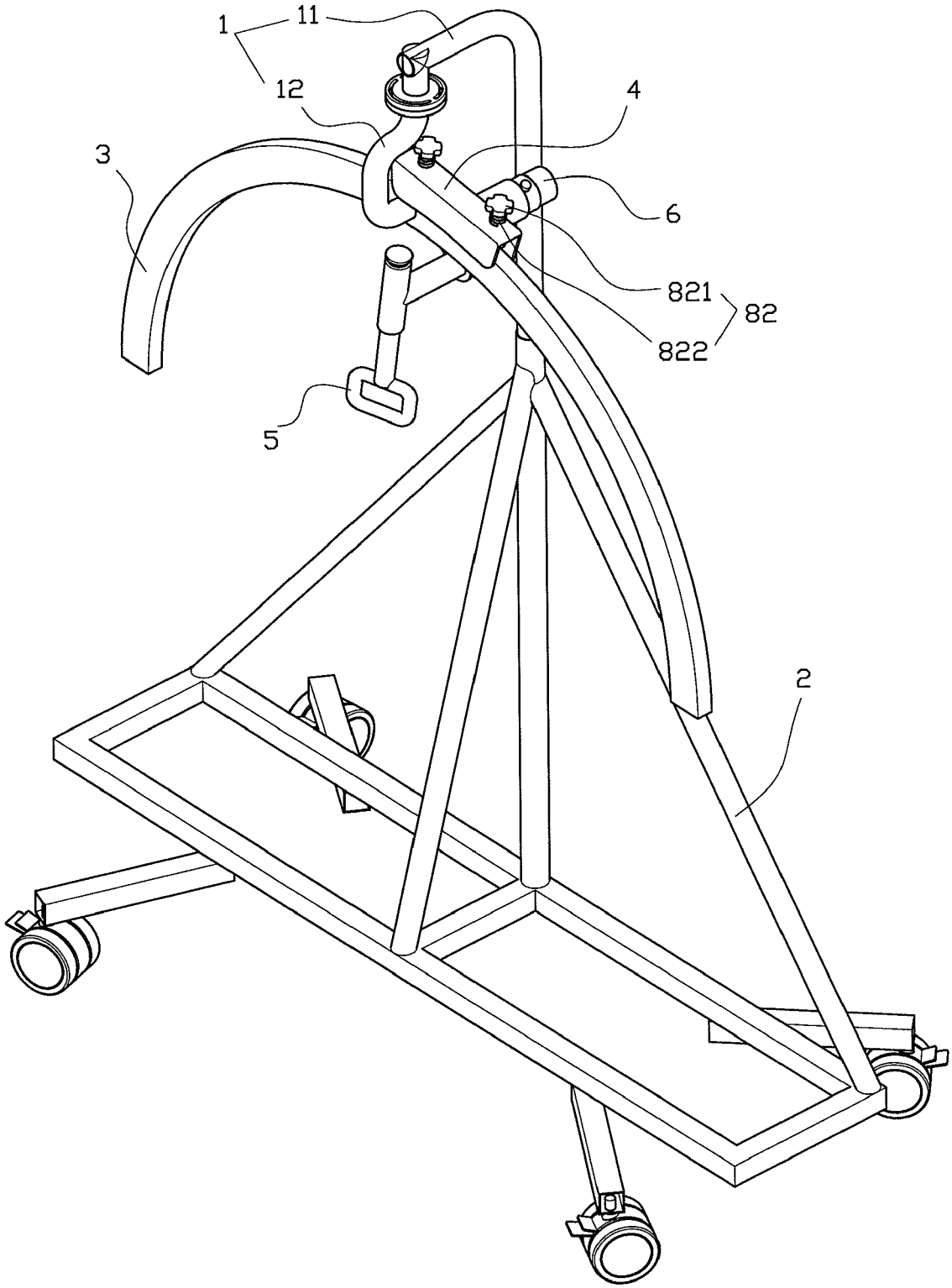
FIG. 1 is a perspective view to show the upper limbs rehabilitation device of the present invention.
Figure 2:
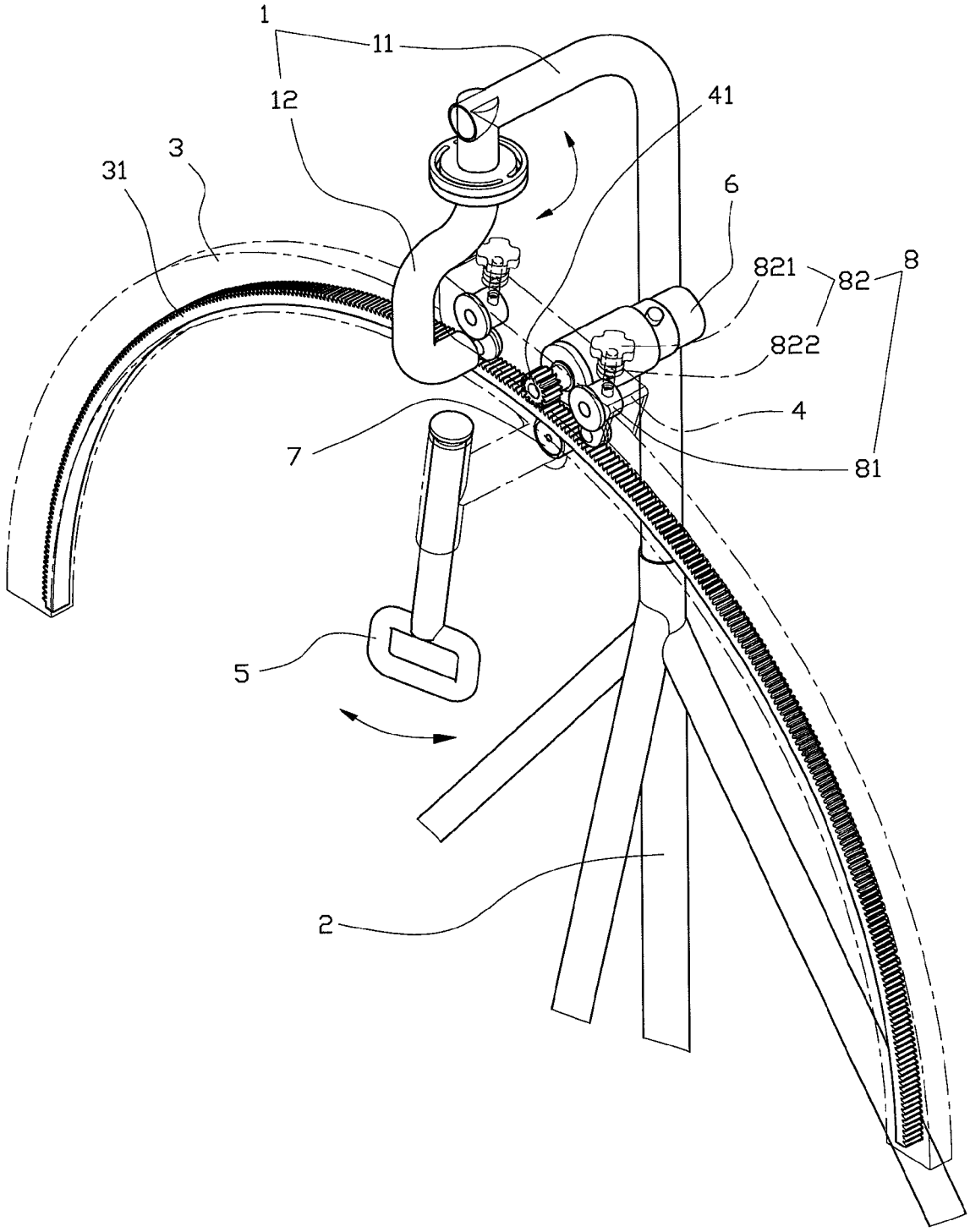
FIG. 2 is an enlarged view to show the rail and the movable member.

Referring to FIGS. 1 and 2, the upper limbs rehabilitation device of the present invention comprises a main body 1 having a first link 11 and a second link 12, wherein the first link 11 has a first end pivotably connected to the second link 12 and a second end of the first link 11 is connected with a cart 2 which is movable to allow different users "A" to use the device. A curved rail 3 is connected to the second link 12. A movable member 4 is connected to the rail 3 and slidable along the rail 3. A grip 5 is pivotably connected to the movable member 4. In this embodiment, the rail 3 includes a toothed rack 31 and the movable member includes a gear 41 which is engaged with the toothed rack 31. The gear 41 is connected to a motor 6. The grip 5 is connected with a resistance sensor 7 which is electrically connected to the motor 6. A resistance control unit 8 is connected between the rail 3 and the movable member 4. The resistance control unit 8 comprises two rollers 81 and two adjustment members 82. The two rollers 81 are connected between the rail 3 and the movable member 4. The two rollers 81 are in contact with the rail 3 and slidable along the rail 3. The two adjustment members 82 each have a bolt 821 and a spring 822. The two bolts 821 respectively extend through the two springs 822 and the movable member 4 and are threadedly connected to the two rollers 81.

Figure 3:
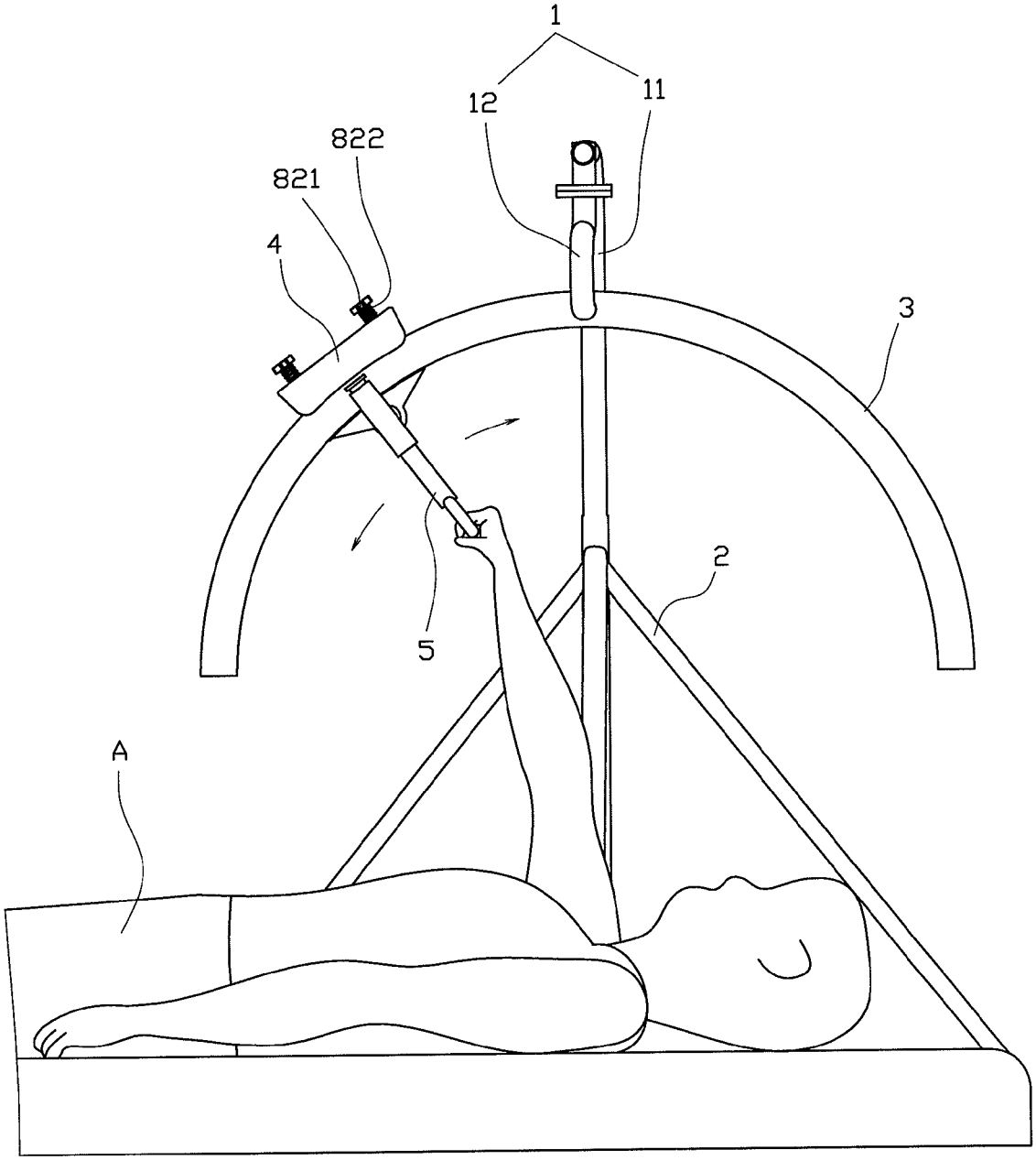
FIG. 3 shows a user using the upper limbs rehabilitation device of the present invention.

Referring to FIGS. 2 and 3, when in use, the second link 12 is rotated relative to the first link 11 and the rail 3 is rotated to a proper position to the user "A". The user "A" holds the grip 5 and moves his/her arm let the gear 41 of the movable member 4 moves along the toothed rack 31 of the rail 3, so that the user's arm swings. Alternatively, the bolts 821 can be threadedly inserted to the rollers 81 to compress the springs 822 which provide resistance between the rail 3 and the movable member 4. When the user "A" wants to move the movable member 4 along the rail 3, the user has to overcome the resistance to move the movable member 4, and this is similar to receive weight training.

The grip 5 is pivotably connected to the movable member 4, so that the user "A" rotates the joint of the upper limb. The way that the grip 5 is pivotably connected to the movable member 4 can be a tight connection instead of freely and pivotably connection. The purpose is that when the user "A" rotates the grip 5, the grip 5 and the movable member 4 have relative movement and generate static frictional force. The static frictional force can be adjusted by adjustment of the connection between the grip 5 and the movable member 4. If the force that applies to the grip 5 is less than the static frictional force, the whole mechanism is stationary. If the force that applies to the grip 5 is larger than the static frictional force, the grip 5 is rotatable so as to exercise the joint of the user's shoulder. In addition, the grip 5 can be set to have a specific length, when the applied force is larger than the static frictional force, the length of the grip 5 is increased or shortened until the force applied is less than the static frictional force, such as when the user bends his/her elbow and the length of the upper limb becomes shorter. The force applied becomes larger than the static frictional force due to gravity. The height of the grip 5 is reduced. The user "A" can adjust the length of the grip 5 according to the user's upper limb so that different users "A" can operate the device. The length of the grip 5 can be adjusted according to the length of the joint of the user's elbow. The length of the grip 5 is timely adjusted according to the resistance of the upper limb of the user "A" so as to prevent injury to the user "A" and to achieve the purposes of rehabilitation.

Besides, when the user's arm cannot apply force to the grip 5, the user "A can activate the motor 6 to move the movable member 4 along the rail 3 by the power from the motor 6. The resistance sensor 7 senses the resistance that the user's arm applies to the grip 5. When the resistance reaches to a critical value, the motor 6 is stopped to prevent injury to the user's arm.

The present invention uses the gear 41 and the toothed rack 31 because the gear 41 and the toothed rack 31 are easily manufactured and the user "A" can count the number of the teeth to gradually increase the angle that the arm swings. Other way to move the movable member 4 along the rail 3 can also be made, such as the movable member 4 includes pulleys and the rail 3 includes grooves for the pulleys.

While we have shown and described the embodiment in accordance with the present invention, it should be clear to those skilled in the art that further embodiments may be made without departing from the scope of the present invention.

What is claimed is:

1. An upper limbs rehabilitation device, comprising:

a main body having a first link and a second link which is pivotably connected to the first link;

a rail connected to the second link;

a movable member connected to the rail and slidable along the rail, and a grip pivotably connected to the movable member;

wherein the near is connected to a motor;

wherein the grip is connected with a resistance sensor which is electrically connected to the motor.

2. The device as claimed in claim 1, wherein the rail is a curved rail.

3. The device as claimed in claim 2, wherein the rail includes a toothed rack and the movable member includes a gear which is engaged with the toothed rack.

4. The device as claimed in claim 1, wherein a resistance control unit is connected between the rail and the movable member.

5. The device as claimed in claim 4, wherein the resistance control unit comprises two rollers and two adjustment members, the two rollers are connected between the rail and the movable member, the two rollers are in contact with the rail and slidable along the rail, the two adjustment members each have a bolt and a spring, the two bolts respectively extend through the two springs and the movable member and are threadedly connected to the two rollers.

6. The device as claimed in claim 1, wherein the first link is connected with a cart.

7. The device as claimed in claim 1, wherein a resistance control unit rides only on the rail.

8. The device as claimed in claim 1, wherein the first link and the second link are pivotable about a vertical axis.

9. The device as claimed in claim 1, wherein a connection of the grip to the movable member has an adjustable static frictional force.

* * * * *